United States Patent [19]

Vermij

[11] Patent Number: 4,703,299

[45] Date of Patent: Oct. 27, 1987

[54] HIGH CURRENT INTERRUPTING FUSE WITH ARC QUENCHING MEANS

[75] Inventor: Leendert Vermij, Buren, Netherlands

[73] Assignee: Littelfuse-Tracor B.V., Utrecht, Netherlands

[21] Appl. No.: 847,951

[22] Filed: Apr. 3, 1986

[30] Foreign Application Priority Data

Apr. 4, 1985 [NL] Netherlands ..... 8501004

[51] Int. Cl.[4] ..... H01H 85/04; H01H 85/14

[52] U.S. Cl. ..... 337/158; 337/246; 337/279

[58] Field of Search ..... 337/246, 251, 158, 279, 337/281, 282

[56] References Cited

U.S. PATENT DOCUMENTS 1,545,767 7/1925 Hawkins ..... 337/246
1,945,541 2/1934 Smith ..... 337/246
2,328,825 9/1943 McMahon ..... 337/279
2,363,370 11/1944 Strom ..... 337/279
3,460,086 8/1969 Fister ..... 337/246

*Primary Examiner*—Harold Broome
*Attorney, Agent, or Firm*—Russell E. Hattis; Stephen R. Arnold

[57] ABSTRACT

The high current interrupting fuse of the invention includes an envelope free of sand or similar arc quenching material. The envelope preferably has terminal end caps enclosing the ends of the envelope between which caps a fuse element extends. The envelope has an arc-quenching gas-releasing material at least at the inner surface of the envelope. Arc barrier plugs made of an ablative material surround each end of the fuse element which for ease of assembly freely pass through bores of plugs. The fuse element also preferably passes through metal plates externally of the plugs and adjacent to the end caps.

5 Claims, 10 Drawing Figures

FIG.8
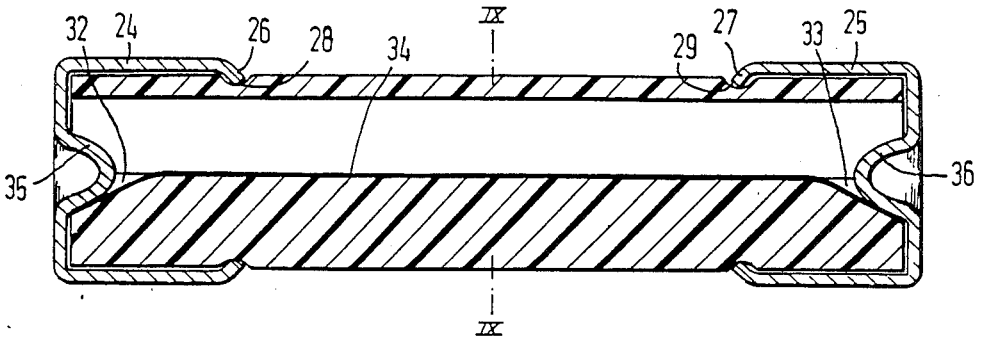
FIG.9
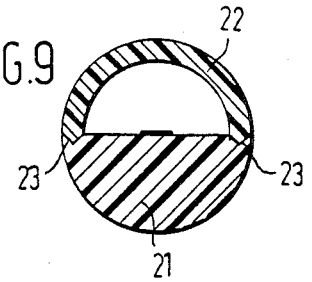
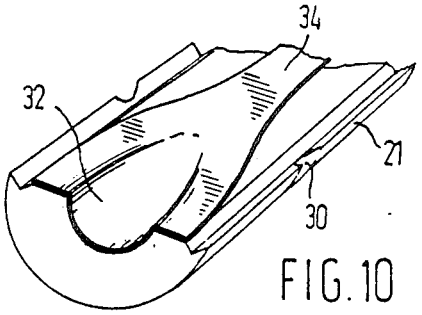
FIG.10

HIGH CURRENT INTERRUPTING FUSE WITH ARC QUENCHING MEANS

BACKGROUND OF THE INVENTION

This invention relates to fuses of a high current interruption capacity where the fuses blow to create high energy arcs at currents of the order of magnitude of at least about 1,000 amps. (Such a fuse excludes, for example, automobile fuses). These high current interruption capacity fuses commonly have a fuse element electrically connected between two cylindrical end cap terminals fitted over the ends of a sand-filled cylindrical envelope. However, some aspects of the invention are not limited to a fuse with a cylindrical envelope, and thus is applicable to one of the "prismatic" type.

In miniature and sub-miniature fuses of this type, operated at relatively low voltages (up to, for example, 150 V), a desired interrupting capacity of 1500A is not unusual and the interruption of higher current intensities of, for example, 5 to 6 kA is sometimes required. When such high currents are interrupted, high energy arcing occurs. If this arc is not quenched before it spreads to the metal end terminals of the fuse, the interruption is not effective and the fuse can undesirably explode. In order to quench the arc before this occurs, fuses designed for use with high interrupting capacity are commonly filled with sand. The manufacture of such sand-filled fuses, however, involves higher cost than the manufacture of non-filled fuses. There is accordingly a need for fuses which need not be filled with sand or the like but yet have a safe high current interrupting capacity.

To this end, various arc-quenching means other than sand have been developed. One such means are solid arc barriers in the form of compressible plugs or the like intimately surrounding the ends of the fuse element to act as barriers to the passage of the arc. Other means utilize plugs of material which substantially completely vaporizes under fuse blowing conditions to fill the fuse envelope with a gas which quenches the arc before it can reach the end terminals of the fuse.

Netherlands patent application No. 8005419 discloses a fuse whose cylindrical envelope is built up from a tubular outer member and a tubular inner member. The inner member is made of a material of high termal conductivity and low thermal shock resistance. When an electrical overload current is passed through the fuse element, the inner member is fragmented. The resulting heat and vapors are absorbed by the fragmented parts which may inhibit the build up of fuse-exploding arcs. This known fuse requires an envelope built up from two concentric tubes. This requirement increases the cost of production. The ability of this fuse to withstand safely high interruption currents is unknown.

One object of the present invention is to provide a fuse of the high current interrupting type which avoids the build-up of fuse-exploding arcs by unique and inexpensive means.

SUMMARY OF THE INVENTION

In accordance with one of the features of the invention, this object is achieved by a unique use of a material which under the high temperature conditions of a blown fuse releases an arc quenching gas at the surface thereof but which preferably maintains its bodily integrity. Such a material will be referred to as an ablative material. The entire envelope is preferably made of such an ablative material. However, at least the inner surface of the envelope uniquely is a material which emits an arc-quenching gas. Some materials which are already ablative by nature, for example, are polytetrafluoroethylene, polyimide, melamine, polysulfon and the like. (While some fuses have heretofore had envelopes made of these materials, such fuses were either of a type where the need for arc quenching materials was not present or the arc quenching nature of such materials was not appreciated and sand was used as the arc quenching material.) Other materials can be rendered ablative, for example, by the absorption of gas on a surface thereof. One example is quartz with fluorine absorbed to its surface. Suitably, also, the fuse element may consist of a core of ablative material with a thin winding or coat of fuse metal on it. (Such a fuse element is per se believed to be old in the art.)

In some fuses according to the invention as just described, hazardous arcing may still occur as the fuse element blows. In order to avoid this, a bored plug preferably of ablative material may be provided within the envelope adjacent each of the fuse terminals, with the fuse element being passed through each of the bores to contact the terminals. Most desirably, the bore through each plug may make an angle with the axis of the envelope. The plug bore is desirably greater in size than the fuse element so that it can be readily be passed through the bore to facilitate assembly of the fuse. The defining walls of the bore are sufficiently close to the fuse wire to act as a barrier to arc passage. Thus, the bore should be no greater than about 20 times the fuse element diameter, and preferably no greater than 10 times thereof to act as an effective barrier to the passage of an arc thereby. The smallest clearance is desired consistent with the desired ease of passage of the fuse element through the bore.

If the envelope consists of a plastically deformable material, it is also possible for the plugs to be formed as an integral part of the envelope, for example, as an inwardly directed, thickened portion of the envelope. While such envelope constructions have been heretofore used, the thickened portions of the envelope walls used to form the plugs were used for centering, not arc-quenching purposes.

In accordance with another feature of the invention, to minimize the possibility that an expanding arc will reach and burn through the cylindrical end caps enclosing the fuse envelope, an apertured metal plate may be disposed separately or contiguous preferably to the outer side of a bored plug of ablative material at each end of the fuse. The fuse element passes through both the bored plug of ablative material and the apertured metal plate. The metal plate adds to the thickness of the arc passage barrier, and the metal generally has a greater burnthrough resistance than an equally sized synthetic plastic member having the desired ablative qualities.

In accordance with another aspect of the invention, which preferably but not necessarily uses an envelope of ablative material, the envelope comprises a pair of confronting insulating longitudinal segments held together by hollow conductive end caps. One of the envelope segments is preferably a solid semi-cylinder, on the inner surface of which is coated a thin metal coating. The other envelope segment is a hollow semi-cylinder. In this embodiment the end caps are preferably each provided with a central, inwardly directed, frusto-conical portion depressed from the end surface, and the solid envelope segment is provided adjacent each of its ends with a semi-conical depression in its surface over which the thin metal fuse metal coating extends. The arrangement is such that the inwardly directed, frusto-conical portion of each end cap is in preferable pressing contact with the thin metal coating provided in the adjacent conical cavity of the solid envelope segment. This unique fuse construction facilitates the low cost manufacture of a reliable fuse.

Various forms of the invention will now be described with reference to the accompanying drawings.

DESCRIPTION OF THE DRAWINGS

FIG. 8 is a cross-sectional view of yet another embodiment of the fuse according to the invention;

FIG. 9 is a cross-sectional view, taken on the line IX—IX of FIG. 8; and FIG. 10 is a perspective view showing a part of the fuse illustrated in FIG. 8.

DESCRIPTION OF EXEMPLARY FORMS OF THE INVENTION

Figures 1, 2, 3, 4:
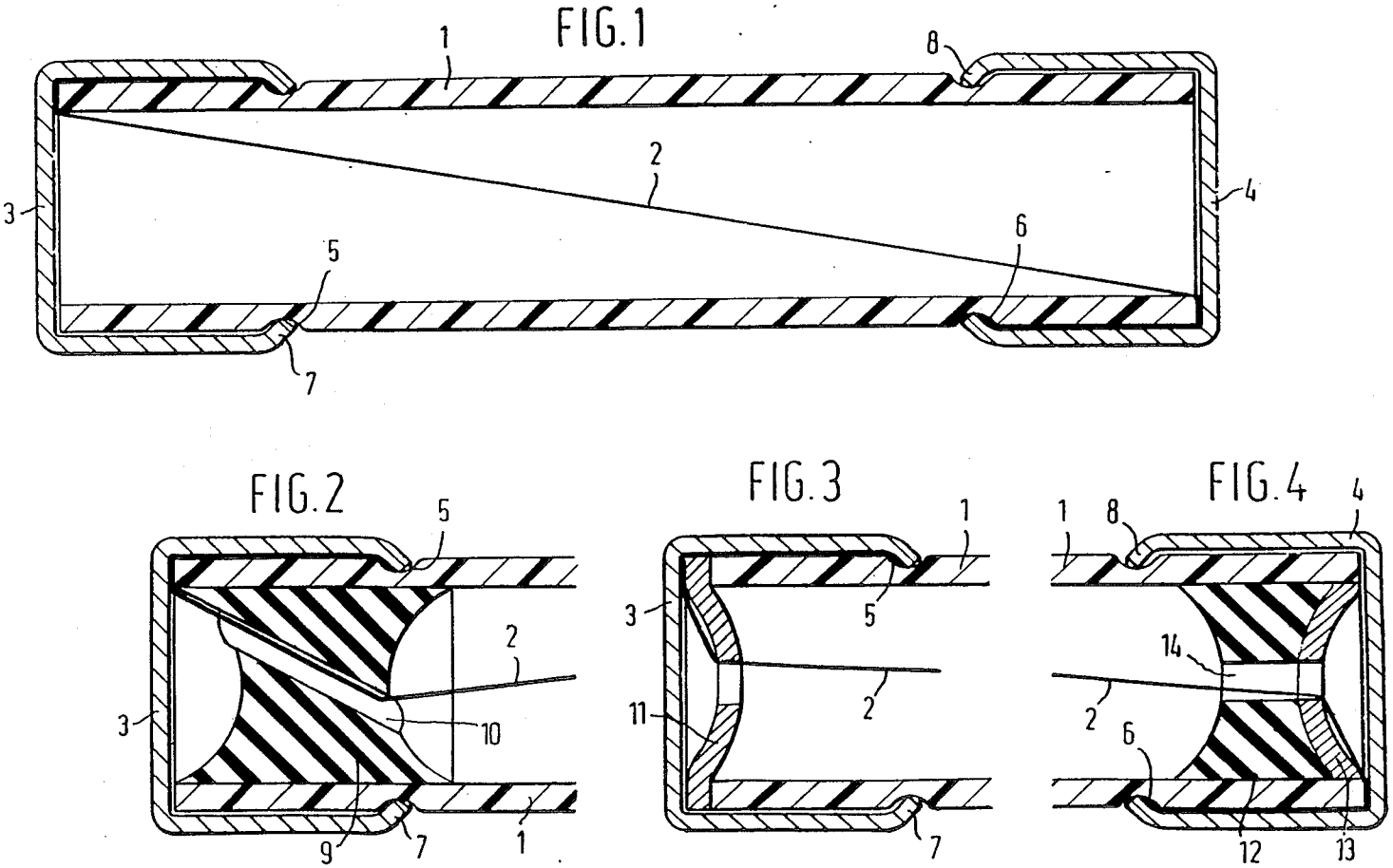
FIG. 1 is a cross-sectional view of one embodiment of the fuse according to the invention.
FIGS. 2–5 are cross-sectional views of an end of various embodiments of the fuse according to the invention.

FIG. 1 illustrates one embodiment of the fuse according to the invention, comprising a substantially cylindrical housing or envelope 1. Arranged within the housing 1 is a fuse element 2, for example, consisting in known manner of a thin metal wire or a coil of thin metal wire wound about an electrical insulating carrier wire of ablative material, which, in either case, may or may not be provided with fuse beads. The fuse element 2 is preferably arranged diagonally within housing 1, with its ends being curved around the edge of housing 1. The ends are clamped between the edge, i.e. the end of housing 1 and suitable end caps 3 and 4 slipped over the ends of the housing 1. Housing 1 consists of a preferably plastic, ablative material. Provided along the circumference of housing 1, transverse to the axis of housing 1, are a pair of grooves 5 and 6. The ends 7 and 8 of the annular part of end caps 3 and 4, which are directed somewhat inwardly, engage in grooves 5 and 6, so that the various parts of the fuse are firmly held together. As shown, the fuse wire 2, the ends of which are bent around the edge of housing 1, may be taken of such length that these ends extend into the grooves and 6, so that they are additionally clamped under the ends 7 and 8 of the end caps. This will further improve the electrical contact between fuse wire and end cap, while soldering the fuse wire to the end caps is entirely superfluous.

The end caps 3 and 4 of the fuse as shown may consist of a material commonly used for end caps, for example, of nickle, nickle-plated brass, silver-plated copper and other metals. The metal wire of the fuse element may also consist of metals commonly used for fuse elements, for example, tin, copper, silver and the like. The housing 1, which may consist of a single cylinder or of two half cylinders placed one upon the other, is made of an ablative material, by which we mean a material from which, at elevated temperature, from dissociation, a gas is released which suppresses the arc as the fuse element blows. Suitable ablative materials are plastic, synthetic plastics materials having a good mechanical strength and resistance to the high temperatures which occur when the fuse blows. Examples of such materials are those known by their tradenames Victrex PEEK, both nonfilled and glass-fibre-filled, Arnite, Ryton R4, Polysulfon and High Heat Lexan. It is also possible, however, to use a housing 1 of a known per se nonablative material of which, however, the surface portion on the inside has been processed to render it ablative. One example is a housing of quartz with fluorine absorbed in the inner surface thereof.

In miniature and subminiature fuses (dimensions for example $5\times20$ mm or $6.3\times32$ mm) a filling of fine sand has hitherto been used for high interrupting capacities (current intensities of more than 1500A), which sand served to suppress or quench the arc occurring as the fuse blows. By using an ablative material according to the present invention such a filling of sand can be omitted. The role of the sand is, as it were, taken over by the gas released from the ablative material.

FIGS. 2–5 illustrate cross-sectional views of one end of various other embodiments of the fuse according to the invention. Corresponding parts are provided with the same reference numerals as used in FIG. 1.

The end of the fuse shown in FIG. 2 comprises adjacent its end a plug 9 in the cylindrical housing of ablative material. Plug 9 consists of a suitable insulating material which, if desired, may also be ablative. The plug 9 is provided with a throughbore 10 which is at an angle to the axis of housing 1. The fuse element 2 is passed through the bore 10. One object of the provision of plugs 9 adjacent to the ends of cylindrical housing 1 is to prevent the plasma jet accompanying the arc formed when the fuse element blows from hitting the end cap 3 before the arc is suppressed by the gases released from the ablative material of housing 1. Having throughbore 10 extend at an angle to the axis of housing 1 is an additional contribution towards this goal. Good results were achieved with a fuse as shown in which housing 1 consisted of High Heat Lexan with plugs 9 being also formed of High Heat Lexan, while end caps 3 and 4 of nickle-plated brass were used with a fuse wire of copper coated with in, diameter 100/m. A fuse bead, consisting of a droplet of tin, was provided in the centre of the fuse wire.

Another possibility of preventing the end cap from being hit by a possible plasma current is shown in FIG. 3. Instead of a bored plug of insulating material, a pierced metal disc 11 is arranged on, or in, the end of housing 1. In the case illustrated, disc 11 is clamped between the end of housing 1 and the rear end of the sleeve-shaped end cap 3. Fuse element 2 is passed through the aperture in disc 11 and clamped between housing 1 and end cap 3 in the manner discussed with reference to FIG. 1.

A combination of an insulating plug and a metal disc is shown in FIG. 4. In that embodiment, plug 12 and metal disc 13 are formed, as it were, as an integral part. The throughbore 14 through plug 12 and disc 13 is, in this embodiment, concentric with housing 1.

Figure 5:
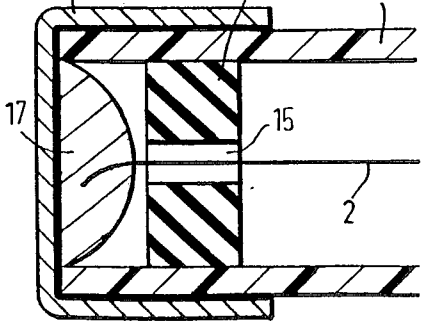

FIG. 5 shows still another embodiment of the way of arranging a plug and fastening a fuse element. In that embodiment, fuse element 2 is passed through a bore 15, concentric with housing 1, formed in a plug 16 of insulating material provided adjacent the end of housing 1.

Fuse element 2 is secured to end cap 3 by means of a solder mass 17.

Figure 6:
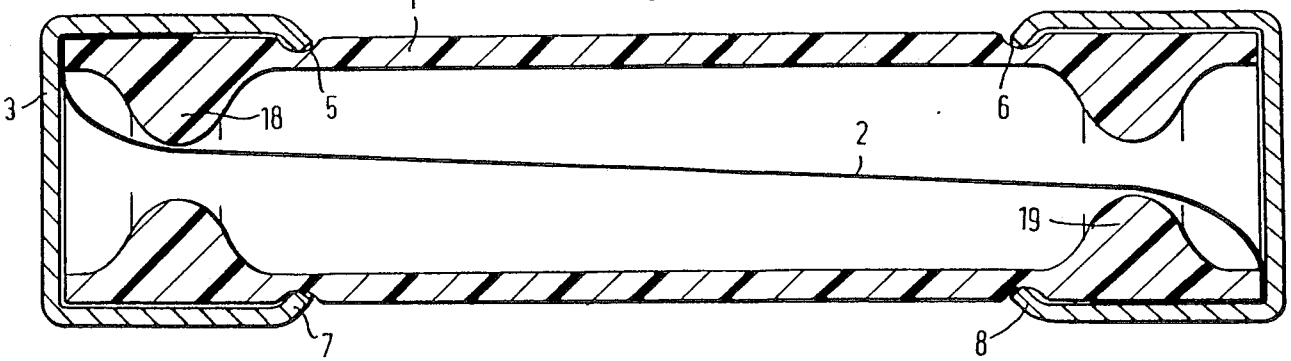
FIG. 6 is a cross-sectional view of still another embodiment of the fuse according to the invention.
Figure 7:
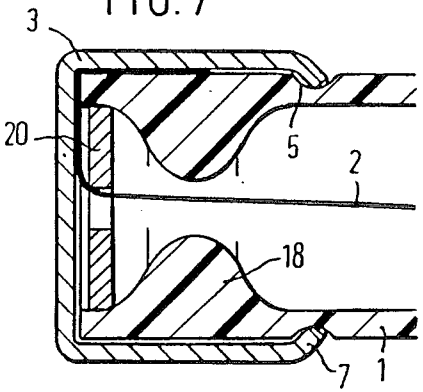
FIG. 7 is a cross-sectional view of an end of a further embodiment of the fuse according to the invention.

FIG. 6 illustrates a cross-sectional view of a suitable embodiment of the fuse according to the invention. In that embodiment housing 1 consists of a plastic or deformable ablative material. In the manufacture of the cylindrical housing 1, which may be built up from two half cylinders, inwardly directed beads or ridges 18 and 19 are provided adjacent the ends, which ridges 18 and 19 have a similar function to the plugs in the embodiments illustrated in FIG. 2, 4 and 5. The plasma jet preventing effect can be enhanced still further by the use of a pierced metal plate or disc 20 between end cap 3 and ridge 18, as illustrated in FIG. 7. Incidentally, plugs, discs and/or ridges can help to keep fuse element properly centered within housing 1 in all of the embodiments discussed.

FIGS. 8–10 illustrate a different embodiment of the fuse according to the invention. FIG. 8 is a cross-sectional view; FIG. 9 shows a sectional view taken on the line IX-9 of FIG. 8; and FIG. 10 gives a perspective view of a portion of a part of the device shown in FIG. 8. Like parts in FIGS. 8–10 are designated by like reference numerals.

The fuse illustrated in FIGS. 8–10 comprises a longitudinal envelope segment or carrier body 21 preferably in the form of a solid half cylinder of an ablative electrical insulating material. Secured to carrier body 21 is a longitudinal hook-forming envelope segment preferably in the form of semicylindrical or half hollow tube 22 of an electrical insulating material, which half hollow tube 22 also consists of an arc-quenching ablative material. The carrier body 21 has a flat inner surface 21*a* enclosed by the half tube 22 and together form a cylindrical envelope with a cavity therein defined by the inner surface 21*a* of carrier 21 and the cylindrical inner surface of the half tube 22. The half hollow tube 22 is arranged to fit carrier 21, for example, by the edges of tube 22 engaging in longitudinal grooves 23 in carrier 21, as shown in FIG. 9. Half hollow tube 22 and carrier 21 are kept clamped together by end caps 24 and 25 slipped over the ends of the assembled cylinder. End caps 25 and 25 each consist of a base and an annular upstanding rim, which annular upstanding rim engages around the assembled cylinder formed by carrier 21 and half tube 22. At the end of the annular upstanding rim of end caps 24 and 25 away from the base, the annular rim is curved slightly inwardly as indicated at 26 and 27. Suitable grooves 28 and 29, extending transverse to the axis, are formed in the outer surface of half tube 22. Similarly, suitable grooves 30 and 31, transverse to the axis, are provided in the outer surface of carrier 21. The inwardly curved rim 26 of the end cap 24 engages in grooves 28 and 30, and the inwardly curved rim 27 of end cap 25 engages in grooves 29 and 31, so that a firm and rigid construction in ensured.

Formed in the plane upper surface of the solid carrier 21, adjacent each of the ends, is a semi-conical recess 32 and 33, respectively. Provided on the upper surface of carrier 21 is a fuse element in the form of a thin metal coat 34. In the embodiment shown, metal coat 34 is of such shape that the coat is broad at the ends of the carrier, where it also covers the semi-conical recess 32 and 33, and becomes narrower towards the center of carrier 21. Naturally it is possible for fuse elements to be made of different design, for example, as a coat which is equally broad throughout the entire carrier with a thinned or tapered portion adjacent to the center of the carrier. The plane surface of the carrier 21, on which the metal coat 34 is provided, need not necessarily be smooth. Grooves or pits may suitable be formed in this surface. It has been found that, with a suitably selected pattern of grooves or pits, the interruption behavior of the fuse, particularly as regards time and place of interruption, can be influenced.

The base of end cap 24 is provided with a central, inwardly directed, frusto-conical portion 35 recessed from the base surface. Similarly, end cap 25 is provided with a similar frusto-conical portion 36. When end caps 24 and 25 have been placed is position, the frusto-conical portions 35 and 36 press against the metal coat 34 applied over the semi-conical cavity 32 and 33 in carrier 21. There is thus obtained a good electrically conducting contact between end caps 24 and 25 and the metal coat 34 forming the fuse element.

The ablative effect is thus most effective if the dimensions of the hole or cavity in which the arc is burning after the fuse blows is of the same order of magnitude of the cross-section of the arc which is greater than the size of the fuse element; the hole or cavity would typically be less than 10 mm in case of a cylindrical hole.

This will especially be the case if there exists so to say a direct contact between an arc barrier-forming wall and the ionized gas forming the arc, meaning in general that the radial expansion of the arc column is limited by the presence of such a wall. So the dimensions of an arc barrier-forming hole in which the arc is burning should be of limited values. In normally sized miniature fuses, e.g. $5\times20$ mm and $6.3\times32$ mm, such a requirement is fulfilled in general. It may, however, be clear that the ablative action not only comes into existance in cylindrical holes, but also in other shaped holes or cavities of suitable dimensions.

It is intended that broad claims not specifying details of a particular embodiment disclosed herein as the best mode contemplated for carrying out the invention should not be limited to such details. Further, while specific claimed details of the invention generally constitute important specific aspects of the invention, in appropriate instances even the specific claims involved should be construed in light of the doctrine of equivalents.

I claim:

1. A fuse comprising a fuse element arranged between two terminals in an insulating envelope, said fuse element comprising an appropriate electrically conductive material and being on opposite ends electrically connected with said terminals, characterized in that said envelope comprises a first longitudinal fuse element-supporting segment on an inner surface of which is supported a fuse element, and a longitudinal hood-forming segment longitudinally confronting and substantially spaced from and enclosing the inner side of said first envelope segment, and said terminals being in the form of end caps at opposite ends of said envelope which engage around and aid in securing together the confronting envelope segments, said end caps each having a centrally inwardly directed portion depressed from the end surface, said first envelope segment being provided adjacent each of its ends with a depression in its surface, over which the end of said fuse element extends, the arrangement being such that the inwardly directed portion of each end cap is in pressing electrical contact with the end of the fuse element thereat.

2. The fuse of claim 1 wherein said envelope is made at least in part of a material which dissociates at least at its inner surface at the temperature occurring under fuse blowing conditions to release gas which suppresses arcing when said fuse element blows.

3. A fuse comprising a fuse element arranged between two terminals in an insulating envelope, said fuse element comprising an appropriate electrically conductive material and being on opposite ends electrically connected with said terminals, characterized in that said envelope comprises a first longitudinal fuse element-supporting segment on an inner surface of which is supported a fuse element deposited thereon in the form of a coating, and a longitudinal hood-forming segment longitudinally confronting and substantially spaced from and enclosing the inner side of said first envelope segment, and said terminals being in the form of end caps at opposite ends of said envelope which engage around and aid in securing together the confronting envelope segments, said end caps each having a centrally inwardly directed portion depressed from the end surface, and the first envelope segment is provided adjacent each of its ends with a depression in its surface, over which the end of said fuse element extends, the arrangement being such that the inwardly directed portion of each end cap is in pressing electrical contact with the end of the fuse element thereat, and wherein said envelope is made at least in part of a material which dissociates at least at its inner surface at the temperature occurring under fuse blowing conditions to release gas which suppresses arcing when said fuse element blows.

4. A fuse according to claim 2 or 3, characterized in that the entire envelope is made of an ablative material which substantially permanently maintains its integrity while releasing said gas at the inner surface thereof exposed to the fuse blowing conditions.

5. A fuse according to claim 1 wherein said fuse element is a coating deposited on the inner surface of said first envelope segment.

* * * * *